US008563882B2

(12) United States Patent
Yang

(10) Patent No.: US 8,563,882 B2
(45) Date of Patent: Oct. 22, 2013

(54) ELECTRONIC CIRCUIT BREAKER HAVING A LOCKING AND UNLOCKING MECHANISM AND METHODS OF OPERATING SAME

(75) Inventor: Guang Yang, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 174 days.

(21) Appl. No.: 13/267,953

(22) Filed: Oct. 7, 2011

(65) Prior Publication Data

US 2012/0085627 A1 Apr. 12, 2012

Related U.S. Application Data

(60) Provisional application No. 61/392,189, filed on Oct. 12, 2010.

(51) Int. Cl.
*H01H 9/28* (2006.01)

(52) U.S. Cl.
USPC ..... 200/43.16

(58) Field of Classification Search
USPC ..... 200/43.01, 43.07, 43.22, 239, 321, 327, 200/339, 16 R, 16 C; 324/424; 335/6–46, 335/156–158
See application file for complete search history.

(56) References Cited

U.S. PATENT DOCUMENTS

| | | | |
|---|---|---|---|
| 3,680,014 | A | 7/1972 | Wilkinson |
| 5,729,145 | A | 3/1998 | Blades |
| 5,946,174 | A | 8/1999 | Kaiser |
| 6,617,858 | B1 | 9/2003 | Baumgaertl |
| 6,633,824 | B2 | 10/2003 | Dollar |
| 7,113,062 | B2 | 9/2006 | Carton |
| 7,368,918 | B2 | 5/2008 | Henson |
| 7,391,289 | B2 | 6/2008 | Holland |
| 7,492,163 | B2 | 2/2009 | Restrepo |
| 7,864,492 | B2 | 1/2011 | Endozo |
| 7,936,542 | B2 | 5/2011 | Lowther |
| 2009/0189719 | A1 | 7/2009 | Yang |

OTHER PUBLICATIONS

PCT International Search Report mailed Feb. 1, 2012 corresponding to PCT International Application No. PCT/US2011/055572 filed Oct. 10, 2011 (7 pages).

*Primary Examiner* — Edwin A. Leon
*Assistant Examiner* — Anthony R. Jimenez

(57) ABSTRACT

Embodiments provide an electronic circuit breaker. The electronic circuit breaker has main electrical contacts configurable between an opened and a closed condition, a handle coupled to at least one of the main electrical contacts, the handle moveable between at least an ON configuration and an OFF configuration, secondary electrical contacts configured to engage each other in the ON configuration, and a moveable stop operable to maintain separation of the main electrical contacts initially when moved toward the ON configuration, and operable to unlock and allow closing of the main electrical contacts upon successful completion of a self-test. A method of operating the electronic circuit breaker is provided, as are other aspects.

19 Claims, 7 Drawing Sheets

ELECTRONIC CIRCUIT BREAKER HAVING A LOCKING AND UNLOCKING MECHANISM AND METHODS OF OPERATING SAME

RELATED APPLICATIONS

This application claims priority to U.S. Provisional. Application Ser. No. 61/392,189 entitled "CIRCUIT BREAKER LOCKING AND UNLOCKING MECHANISM" filed on Oct. 12, 2010, the disclosure of which is hereby incorporated by reference in its entirety herein.

FIELD OF THE INVENTION

The present invention relates generally to a circuit breaker for interrupting current from an electrical power supply, and more particularly to a circuit breaker including a locking and unlocking mechanism.

BACKGROUND OF THE INVENTION

Circuit breakers are used in certain electrical systems for protecting an electrical circuit coupled to an electrical power supply. For example, electronic circuit breakers, such as Arc Fault Circuit Breakers (AFCIs), Ground Fault Circuit Interrupters (GECIs), Transient Voltage Surge Suppressors (TVSSs), and surge protectors, use electronic components to detect certain types of faults, such as arc faults and ground faults.

If one or more of the electronic components in such a circuit breaker fails in some way, the circuit breaker may be unable to electrically protect the one or more electrical branch circuits that are connected to the circuit breaker. Accordingly, it would be desirable to check the electronic circuit or electronic components of the circuit breaker prior to closing the main contacts of the circuit breaker.

SUMMARY OF THE INVENTION

In a first aspect, an electronic circuit breaker is provided. The electronic circuit breaker includes main electrical contacts configurable between an opened and closed condition, a handle coupled to at least one of the main electrical contacts, the handle moveable between at least an ON configuration and an OFF configuration, secondary electrical contacts configured to engage each other in the ON configuration, and a moveable stop operable to maintain separation of the main electrical contacts initially when moved toward the ON configuration, and operable to allow closing of the main electrical contacts upon successful completion of a self test.

In another aspect, an electronic circuit breaker is provided. The electronic circuit breaker includes main electrical contacts configurable between an opened and closed condition, at least one of the main electrical contacts being a stationary main electrical contact and the other being a moveable main electrical contact, the moveable main electrical contact being mounted on a moveable contact arm, a handle coupled to the moveable contact arm to enable movement of the moveable contact arm, the handle moveable between at least an OFF configuration an ON configuration, secondary electrical contacts configured to engage each other when the handle is in the ON configuration, and a moveable stop operable to contact and lock the moveable contact arm and maintain separation of the main electrical contacts when initially moved toward the ON configuration, the moveable stop adapted to allow release of the moveable contact arm to allow closing of the main electrical contacts upon successful completion of a self test.

According to another aspect, a method of operating an electronic circuit breaker is provided. The method includes providing a main electrical contacts, at least one being a moveable main electrical contact, moving a handle coupled to the moveable main electrical contact toward an ON configuration causing initial movement of the moveable main electrical contact, blocking further motion of the moveable main electrical contact with a moveable stop as the handle is moved to the ON configuration, causing contact between secondary contacts as the handle reaches the ON configuration, performing a self test, and releasing the moveable main electrical contact by moving the moveable stop and allowing the main electrical contacts to close and make electrical contact.

Still other aspects, features, and advantages of the present invention may be readily apparent from the following detailed description by illustrating a number of exemplary embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the invention.

DETAILED DESCRIPTION

Figure 1:
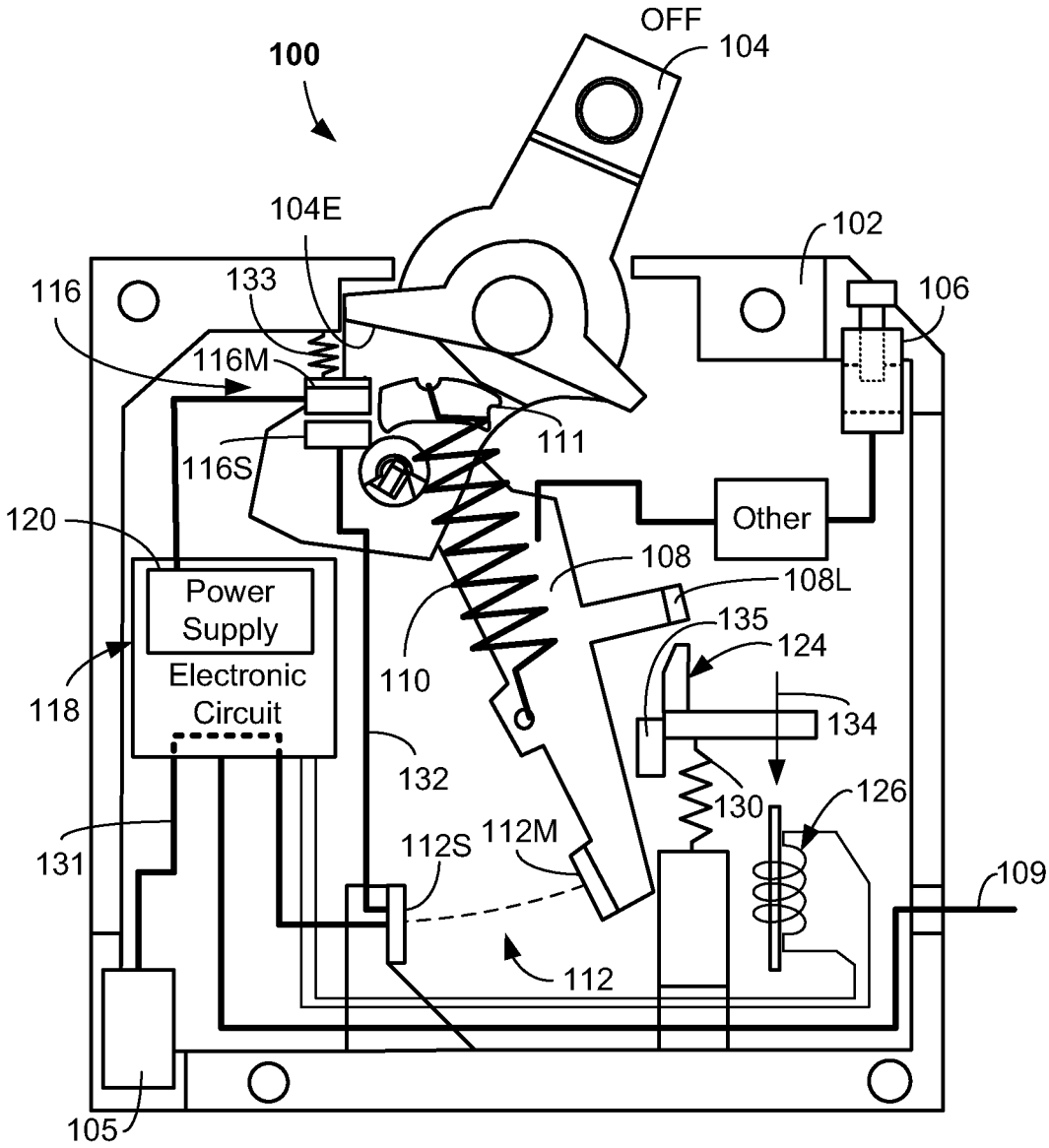
FIG. 1 is a side view of several components of a circuit breaker of the present invention shown in an OFF configuration.

In view of the foregoing difficulties, a circuit breaker is provided that has a locking and unlocking mechanism with a moveable stop adapted to allow locking of a moveable contact arm of the circuit breaker as the circuit breaker is moved toward an ON configuration. The electronic circuit breaker includes main electrical contacts and secondary electrical contacts. According to one aspect, closing of the secondary electrical contacts is accomplished in the ON configuration.

Secondary electrical contact closing may initiate powering the electronic circuit of the circuit breaker. Once powered, a self test may be carried out on the electronic circuit of the circuit breaker in the locked state. If the self test is passed, then the moveable contact arm may be unlocked through disengaging the moveable stop of the locking and unlocking mechanism from the moveable contact arm. This allows the moveable contact arm to move (e.g., pivot) so that the main electrical contacts may be closed (provided in electrical contact). In contrast, if the electronic circuit breaker is determined to have a failed electronic circuit or component as a result of a failed self test, then the moveable contact arm and moveable stop remain in a locked configuration so that the main electrical contacts remain separated. Moreover, upon failure and subsequent release of the handle by the user, the handle will return to the OFF configuration.

According to embodiments, the electronic circuit breaker includes main electrical contacts that may be provided in an opened (non-contacting) or closed (contacting) condition. At least one of the main electrical contacts (e.g., a moveable main electrical contact) is coupled to the moveable contact arm. The moveable stop of a locking and unlocking mechanism operates to engage a portion of the moveable contact arm to hold (lock or block) the main electrical contacts apart initially as the handle is moved towards the ON configuration. Secondary electrical contacts are moved into engaging contact as a result of the motion of the handle to the ON configuration. As the secondary electrical contacts engage in the ON configuration, the electronic circuit of the electronic circuit breaker may be powered, and a self test of the electronic circuit of the circuit breaker may be performed, either automatically or manually through pushing a Push-To-Test (PTT) button, but preferably automatically. If criteria indicating an acceptable electronic circuit condition is met, then an unlock actuator (e.g. a relay or solenoid) of the locking and unlocking mechanism will cause the moveable stop to move and resultantly release (e.g., unlock) the moveable contact arm. The unlocking allows the moveable contact arm to move (e.g., further pivot) and the main electrical contacts to engage each other in the ON configuration thereby readying the electronic circuit breaker to protect an attached electrical circuit branch.

According to another aspect of the invention, the secondary electrical, contacts may continue to be engaged and in contact with one another by action of the handle when in the ON configuration. This feature of continuous contact between the secondary electrical contacts in the ON configuration may not only be used to automatically initiate the self test, but may be used to provide continuous power the electronic circuit of the circuit breaker, and/or initiate monitoring of the electrical branch coupled to the circuit breaker after the self test is passed and the contact arm released.

Advantageously, the present invention enables the ability to immediately provide power to the electronic circuit of the circuit breaker when the circuit breaker is in the ON configuration (both unreleased and released ON configurations). Furthermore, the present invention simplifies the construction of the mechanisms that were required in the prior art to reopen the secondary contacts as the circuit breaker handle was moved from an OVER ON configuration to the ON configuration, as disclosed in US Pub. No. 2009/0189719 entitled "Circuit Breaker Locking And Unlocking Mechanism," the disclosure of which is hereby incorporated by reference in its entirety herein.

In another broad aspect, a method of operating an electronic circuit breaker is provided. According to the method, a handle coupled to a moveable main electrical contact is moved towards an ON configuration to cause initial movement of the moveable main electrical contact. Further motion of the moveable main electrical contact is blocked by a moveable stop as the handle is moved towards the ON configuration. As the handle reaches the ON configuration, electrical contact between secondary electrical contacts is made thereby powering the electronic circuit in the circuit breaker. A self test is then performed, and if test criteria is met indicating the electronic circuit is functioning properly, then the moveable main electrical contact is released by moving the moveable stop and allowing the main electrical contacts to close and make electrical contact with each other.

The present invention is not limited to the illustrative examples for single-pole electronic circuit breakers described herein, but is equally applicable to other types of electronic circuit breakers. For example, this aspect of present invention may be useful with other circuit breakers, such as two-pole electronic circuit breakers, surge protective devices such as transient voltage surge protection (TVSS) devices, metering circuit breakers, electronic trip unit circuit breakers, and remotely controllable circuit breakers, for example. Other types of circuit breakers including single or multiple electrical branches may benefit as well.

These and other embodiments of electronic circuit breakers, circuit breaker components, and methods of operating the electronic circuit breaker of the present invention are described below with reference to FIGS. 1-6. The drawings are not necessarily drawn to scale. Like numerals are used throughout the specification to denote like elements.

Referring now in specific detail to FIGS. 1-4, an electronic circuit breaker 100 is shown. Some portions or all of the conventional and other mechanical components (e.g., cradle, armature, magnet, bimetal, armature spring have been removed for clarity and to aid in understanding the novel and unobvious features of the present invention. The electronic circuit breaker 100 will be referred to herein as "electronic circuit breaker" or lust "circuit breaker." The electronic circuit breaker 100 includes a breaker housing 102, which may be formed from several molded housing portions. In the depicted embodiment of a single-pole circuit breaker, left housing portion and right housing portion may interconnect with each other via multiple fasteners (e.g., rivets) to form the housing 102 and internal spaces and surfaces to contain, mount, and retain the other circuit breaker components. The housing 102 may be made from any suitable rigid plastic, such as thermoset plastic material (e.g., polyester). Other materials may be used. Furthermore, other means of fastening the portions together may be used, such as screws, plastic welding, or adhesive. Furthermore, a higher number of housing portions may be used to form the housing 102. For example, in a two-pole electronic circuit breaker, two mechanical poles are provided in first and second housing portions, and the electronics may be housed in a third center housing section.

Figure 2:
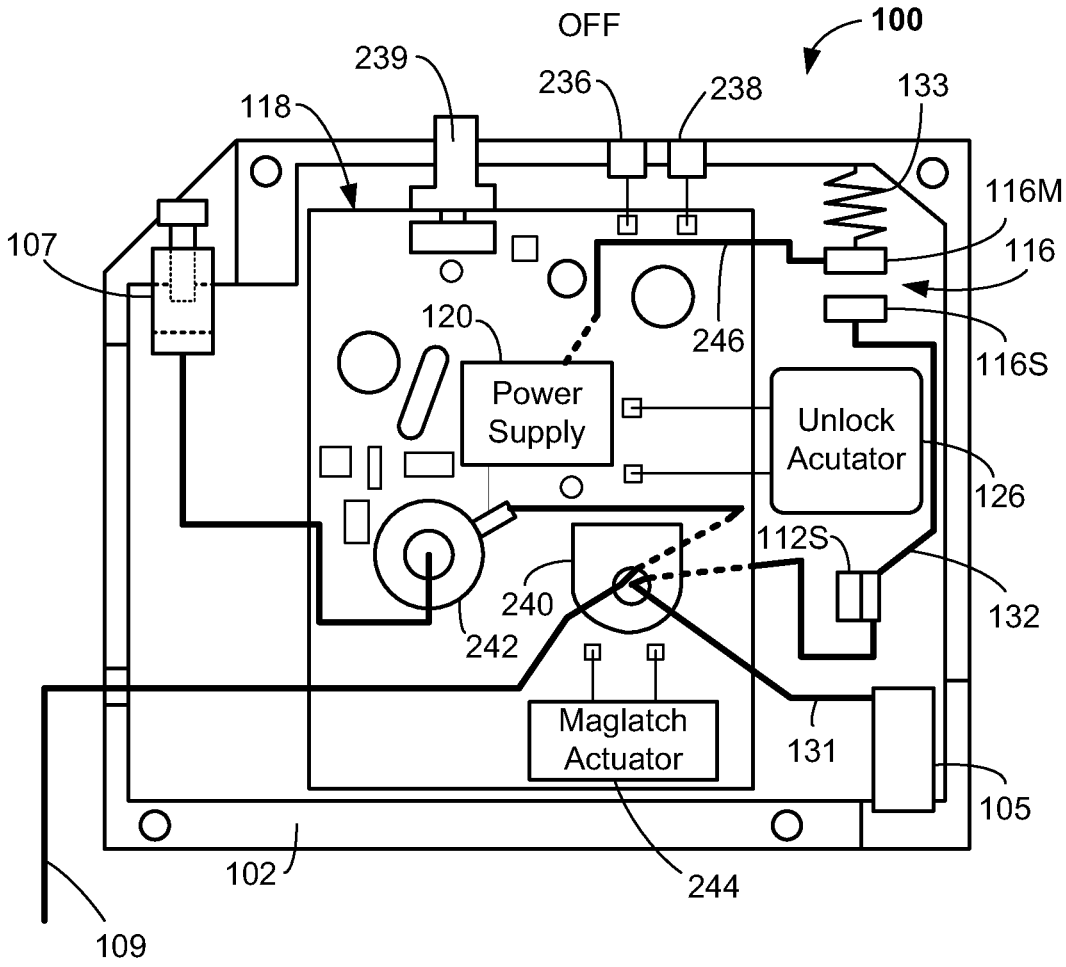
FIG. 2 is a side view of several electrical and electronic components of a circuit breaker of the present invention shown in an OFF configuration.
Figure 3:
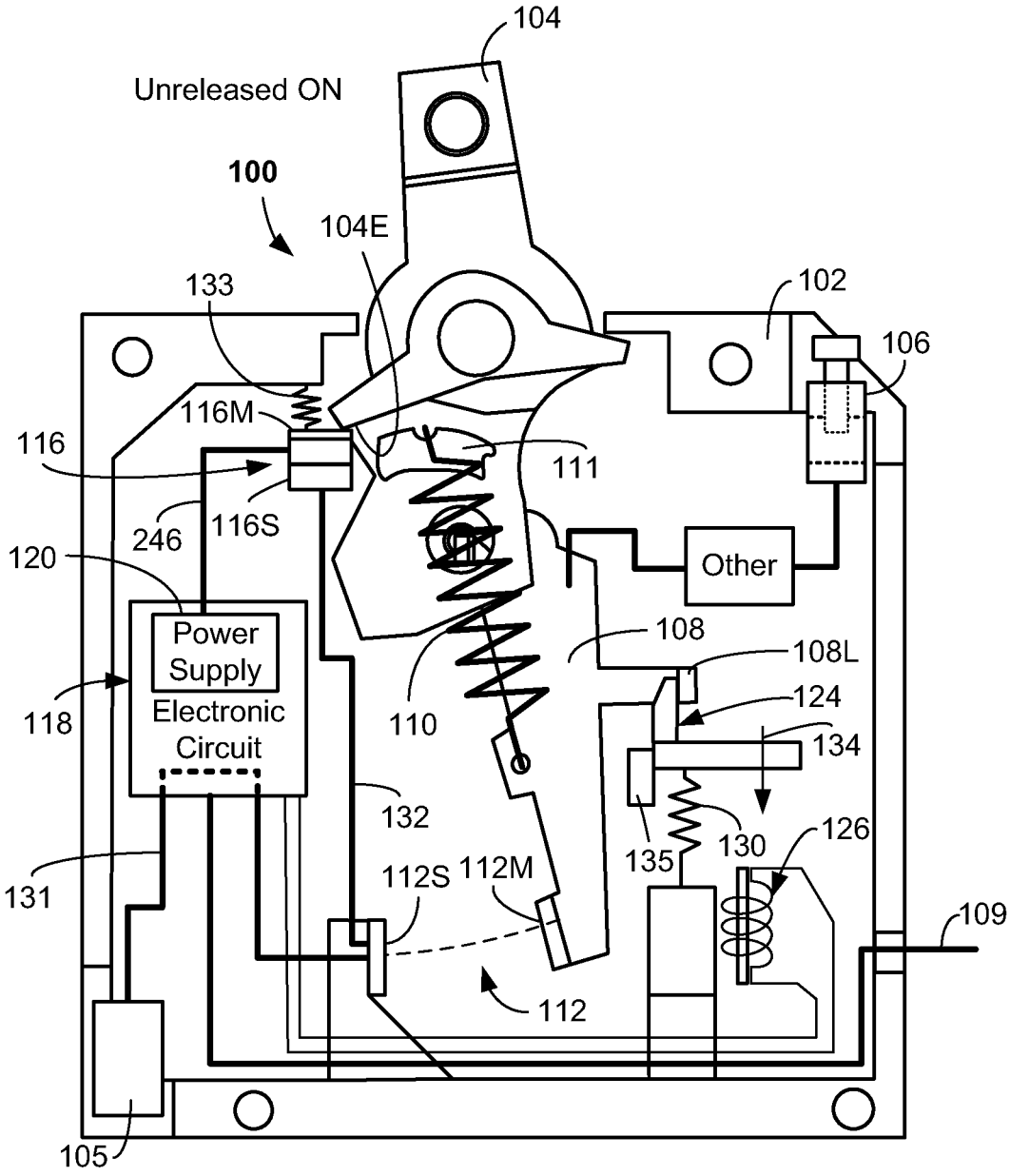
FIG. 3 is a side view of a circuit breaker of the present invention shown in an unreleased ON configuration with the secondary contacts being closed and the contact arm being locked prior to a self test.
Figure 4:
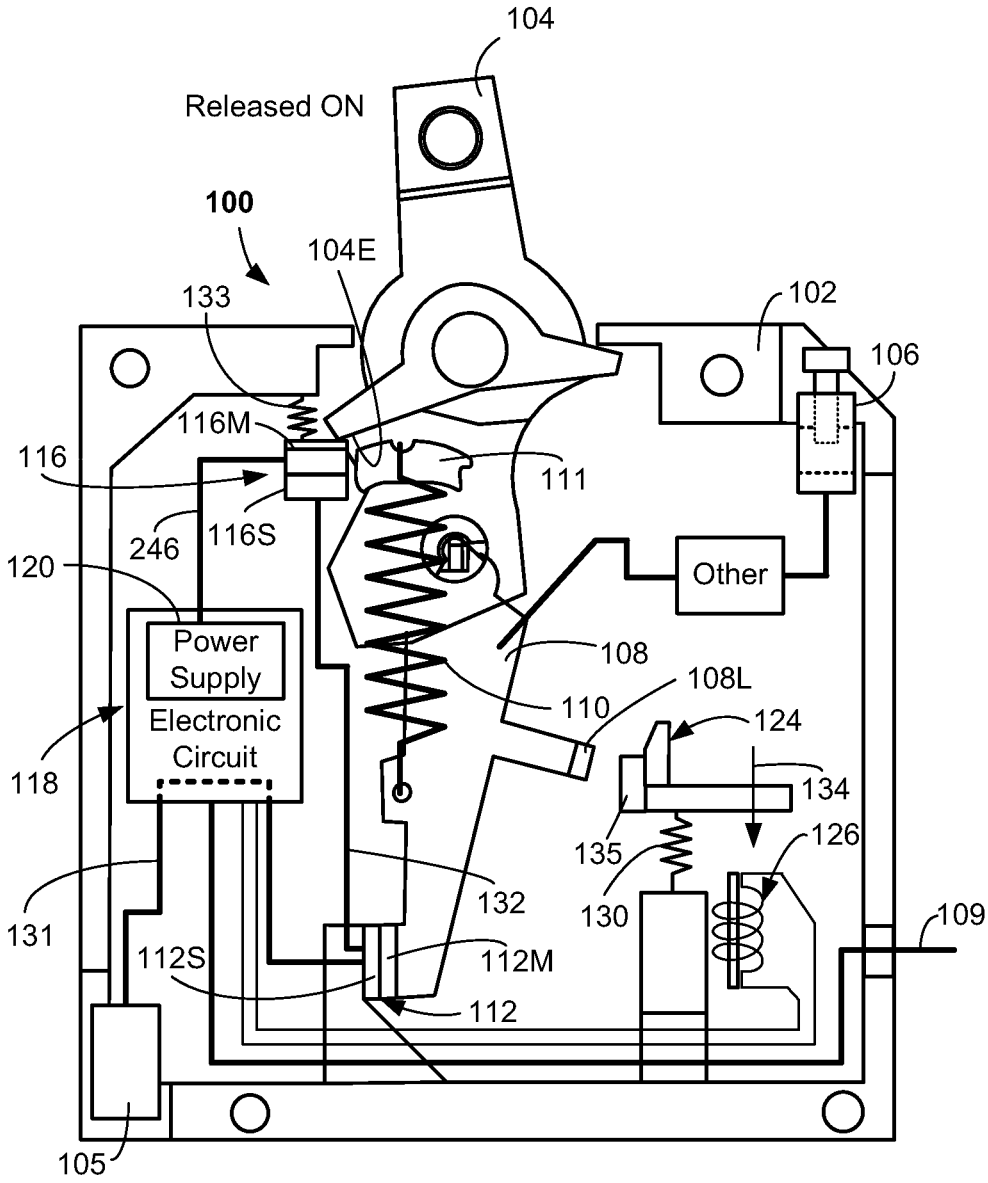
FIG. 4 is a side view of several components of a circuit breaker of the present invention shown in an ON configuration with the main and secondary contacts being closed after passing a self test.

The electronic circuit breaker 100 may include a handle 104 adapted to switch the various breaker components between at least ON and OFF configurations, with the OFF configuration being shown in FIGS. 1 and 2, the unreleased ON configuration be shown in FIG. 3, and the released ON configuration being shown in FIG. 4. Other positions such as TRIP and RESET are not shown. The handle 104 may be used to manually switch the electronic circuit breaker 100 from the OFF configuration to the unreleased ON configuration. Further, the handle 104 may reset the electronic circuit breaker 100 from the TRIP configuration. Handle 104 may also be manufactured (e.g., molded) from a suitable polymer material (e.g. a thermoplastic).

In the depicted embodiment, a power terminal 105 is provided, that may be configured to couple to a conventional stab. A load terminal 106 is also provided and may be operationally connected to an electrical circuit branch including an electrical load (not shown). A load neutral terminal 107 may be provided and may be connected to a load neutral of the protected electrical circuit branch. The electronic circuit breaker 100 may also include neutral pigtail 109 adapted to be secured to a load center neutral (e.g., neutral bar), for example. The handle 104 may operationally interface with a moveable contact arm 108 through a conventional pivot and move the contact arm 108 from an OFF configuration shown to an ON configuration (FIGS. 3 and 4). Spring 110 coupled between the contact arm 108 and a cradle 111 (only a portion shown) provides the spring force to keep the circuit breaker 100 in the selected configuration (Released ON, OFF, TRIP). The spring 110 and cradle 111 are of conventional construction.

Main electrical contacts 112 including a moveable main electrical contact 112M and a stationary main contact 112S engage and disengage each other depending upon the configuration of the circuit breaker 100 (e.g., ON, OFF, TRIP) thereby making the electrical contacts 112 configurable between an opened and closed condition. In the OFF configuration shown in FIGS. 1 and 2, the main electrical contacts 112 are separated from each other thereby opening any attached protected electrical circuit branch.

In the depicted embodiment of electronic circuit breaker 100 shown, secondary electrical contacts 116 including a stationary secondary electrical contact 116S and a moveable secondary electrical contact 116M are also provided. In the OFF configuration, the secondary electrical contacts 116 are opened (not engaged), and thus, no power is provided to the internal electronic circuit 118 of the electronic circuit breaker 100. However, in the ON configuration (FIGS. 3 and 4), the secondary electrical contacts 116 are closed thereby powering the electronic circuit 118. The present invention circuit breaker 100 may also include a power supply 120 adapted to supply electrical power to the components of the internal electronic circuit 118 of the electronic circuit breaker 100.

The circuit breaker 100 also includes locking and unlocking mechanism having a moveable stop 124 provided to be engaged and actuated by an unlock actuator 126, such as an electromagnetic actuator, relay, or solenoid. Any suitable actuator, such as a solenoid comprising a core and surrounding coil windings may be used. In the depicted embodiment, the movable contact arm 108 may include a locking member 108L that is adapted to interact with the moveable stop 124 so as to lock (e.g., block) the contact arm 108 from continued motion at certain times during the operation of the circuit breaker 100. The locking member 108L may be formed as a tab extending from a body of the moveable contact arm 108, for example. However, any suitable structure for the locking member 108L that may be contacted by a moveable stop 124 may be used. Optionally, the body of the contact arm 108 may be contacted directly. Other suitable constructions of the locking and unlocking mechanism may be used, such as is described it US Pub. No. 2009/0189719.

As best shown in FIG. 3, as the handle 104 is moved towards the ON configuration from the OFF configuration, the locking member 108L is configured, positioned, and operable to be received in the way of, and engage, moveable stop 124. The moveable stop 124 is normally positioned in a blocking orientation via the spring force provided by the bias spring 130. The normal motion path of the contact arm 108 as the handle 104 moves the moveable contact arm 108 towards the ON configuration causes contact between the locking member 108L and the moveable stop 124 and blocks and locks the moveable contact arm 108 in a fixed opened position. This locking action maintains separation of the main electrical contacts 112 initially in the unreleased ON configuration shown in FIG. 3. The moveable stop 124 is also operable to allow closing of the main electrical contacts 112, but only upon successful completion of a self test, as will be explained below.

It should be recognized that the secondary electrical contacts 116 come into contact with each other only in the ON configuration (both the unreleased ON (FIG. 3) and the released ON (FIG. 4) configurations). Moreover, on in the released ON configuration, the secondary electrical contacts 116 continue to be engaged in electrical contact. The secondary electrical contacts 116 only engage each other during the ON configuration and are disengaged from each other while in other configurations (OFF, TRIP, and RESET).

Again referring to FIG. 3, when in the unreleased ON configuration, in some embodiments, a self test may be initiated responsive to power being provided to the internal electronic circuit 118 by power supply 120. Closing the secondary electrical contacts 116 supplies current from the power terminal 105, through conductors 131 and 132. Conductor 131 may pass through a sensor (e.g., differential current sensor 240). Closing of the secondary electrical contacts 116 may be accomplished by a portion 104E of the handle or a coupled component contacting the moveable electrical contact 116M or a member coupled to the moveable electrical contact 116M. This operates against a spring force provided by secondary contact spring 133 that normally keeps the contacts 116S and 116M in an opened condition. Any suitable spring 133 may be used, such as a leaf spring (See FIG. 5C). Upon supplying power to the power supply 120 and the electronic circuit 118 by closing the secondary contacts 116, an automatic self test routine may be initiated. The self test may automatically initiate a testing sequence that functions to test the operability and ability of the electronic circuit 118 and/or connected components to properly detect faults (e.g., arc faults, ground faults, or the like). If the pre-established test criteria is met during the self test (e.g., test passed), then a signal may be sent from the electronic circuit 118 to the unlock actuator 126 to move the moveable stop 124 in the direction of arrow 134 thereby unlocking the locking and unlocking mechanism and releasing the moveable contact arm 108. The motion of the moveable stop 124 may be guided by a guiding member 135 of suitable construction to limit movement of the moveable stop 124 to release and locking/blocking motion only. However, any suitable mechanical restraint may be used.

The unlock actuator 126 may operate against the bias spring 130, whereas the bias spring 130 normally provides the moveable stop 124 in a blocking positional orientation. If the self test is failed, indicating a failed electrical component and/or electronic circuit 118, the no signal is provided and the moveable stop 124 continues to block/lock the moveable contact arm 108. This maintains the main electrical contacts 112 in an opened condition. Furthermore, as the handle 104 is released by the user, the handle 104 will move back to the OFF position under the force exerted by main spring 110. This motion of the handle 104 will also open the secondary contacts 116 thereby removing/cutting power to the electronic circuit 118. Advantageously, the present invention provides the ability to failsafe the circuit breaker 100 such that the main electrical contacts 112 cannot be closed until a self test is passed thereby indicating that the electronic circuit 118 is functioning properly.

As shown in FIG. 2, the electronic circuit breaker 100 may optionally include a push-to-test button 239 to initiate the self test once the electronic circuit 118 is energized in the unreleased ON configuration (FIG. 1). Once the self test is passed, then the electronic circuit 118 may send a signal to the unlock actuator 126 to release the moveable contact arm 108 (FIG. 4) and allow the main electrical contacts 112 to close. For illustration purposes, the unlock actuator 126 and the electronic circuit 118 have been shown in the various figures. It should be understood, however, that their positions may differ from that which is shown. Furthermore, the electronic circuit breaker 100 may include one or more status indicators 236, 238, such as LEDs, to indicate the existence of a failed electronic circuit 118 if the self test is failed, or otherwise indicate a detected fault condition in operation when the circuit breaker 100 is in use and coupled to a protected electrical circuit branch.

Referring again to FIG. 2, an illustrative block diagram of the electronic and electrical components of the electronic circuit breaker 100 in accordance with embodiments of the present invention is shown. The electronic circuit breaker 100 includes the power terminal 105, which in the depicted embodiment, may consist of a single power terminal 105 on a line side of the electronic circuit breaker 100. The power terminal 105 may have a U-shaped form and may be adapted to be coupled to a stab provided at a single standard circuit breaker location in a load center. Optionally, a standard assembly including a lug and lug screw may be employed. The term "load center" as used herein refers to any component that includes the ability to distribute electrical power to multiple electrical circuit branches, and which is adapted to receive and mount one or more circuit breakers to protect those electrical circuit branches.

Again referring to FIG. 2, the electronic circuit breaker 100 includes a load neutral terminal 107 integral with the electronic circuit breaker 100 and may be made of conventional lug construction. Connected and protected electrical circuit branches may connect to the load, and load neutral terminals 106, 107.

In more detail, within the electronic circuit breaker 100, a current (e.g., single-phase current) from the power terminal 105 may be carried by input conductor 131 through differential transformer 240 and to the stationary main contact 112S. The power supply conductor 132 supplies power to the power supply 120. The power supply 120 functions to supply power to the electronic circuit 118 of the circuit breaker 100 so that the electronic circuit 118 can perform a self test and perform the electrical circuit branch monitoring function thereafter. Once the self test is passed, and the circuit breaker 100 is released to the released ON configuration shown in FIG. 4, tripping mechanisms including mechanical, electromechanical and material components to accomplish circuit breaker tripping, i.e., separation of the respective main electrical contacts 112 from one another under various circuit fault conditions become operative.

For example, the mechanical tripping mechanism may include a cradle, spring, armature, actuator, magnet, and bimetal element, as is conventional. The electronic tripping mechanism may include the electronic circuit 118, which may be provided on a printed circuit board, and may include one or more sensors 240, 242 that are adapted to sense various current conditions of the connected electrical circuit branch. The electronic circuit 118 may process the indicative signal (s) from the sensors 240, 242. In particular, the electronic circuit 118 may execute an algorithm to determine whether an unwanted electrical condition exists in the protected electrical circuit branch, such as an arc fault (serial or parallel), a ground fault, or other unwanted condition, for example. In some embodiments, the electronic processing circuit 118 may simply monitor the branch circuit condition. In other embodiments, a maglatch may be activated by a maglatch actuator 244 when certain fault criteria are met. This trips the cradle 111 and therefore trips the circuit breaker 100 to the TRIP configuration separating the main contacts 112 and opening the electrical circuit branch. The particular algorithms for determining the existence of an unwanted electrical fault condition, and the electronic circuit components of the electronic circuit 118 will not be further described herein, as they are well known in the art. For example, such circuits and fault detection methods may be found in U.S. Pat. Nos. 5,729,145, 5,946,174, 6,617,858, 6,633,824, 7,368,918, 7,492,163, and 7,864,492, the disclosures of each of which are hereby incorporated by reference herein.

As discussed above, when the handle 104 is moved to the unreleased ON configuration thereby closing the secondary electrical contacts 116, the electronic circuit 118 is powered and a self test may be performed. For example, the self test may be as described in U.S. Pat. No. 7,936,543, the disclosure of which is hereby incorporated by reference herein. Other suitable methods for self testing the health of one or more electronic components, the electrical circuit 118, or the fault detection sub-circuit(s) therein may be performed.

As is illustrated in FIG. 3, when the handle 104 is first moved to the unreleased ON configuration, the moveable secondary electrical contact 116M is urged into direct contact with the stationary secondary contact 116S. This closes the path between the conduit 131 and conduit 246 and therefore provides power to the power supply 120 for the electronic circuit 118 and various electrical components such as the unlock actuator 126 and the maglatch actuator 244.

FIG. 4 illustrates the circuit breaker 100 in the released ON configuration after the self test has been passed. In this configuration, the moveable stop 124 has been retracted by unlock actuator 126 thereby compressing bias spring 130 and releasing the moveable contact arm 108. Once released by the moveable stop 124, the moveable contact arm 108 pivots and moves due to the spring force exerted by main spring 110 to the released ON configuration shown. In the released ON configuration, the moveable man electrical contact 112M on the contact arm 108 comes into direct physical contact with the stationary electrical contact 112S. This completes the circuit and allows power from the power terminal 105 to pass through the main contacts 112 into the contact arm 108 then through the other components in the electrical path (e.g., such as the bimetal and connecting strap) and to the load terminal 106.

Figure 5A:
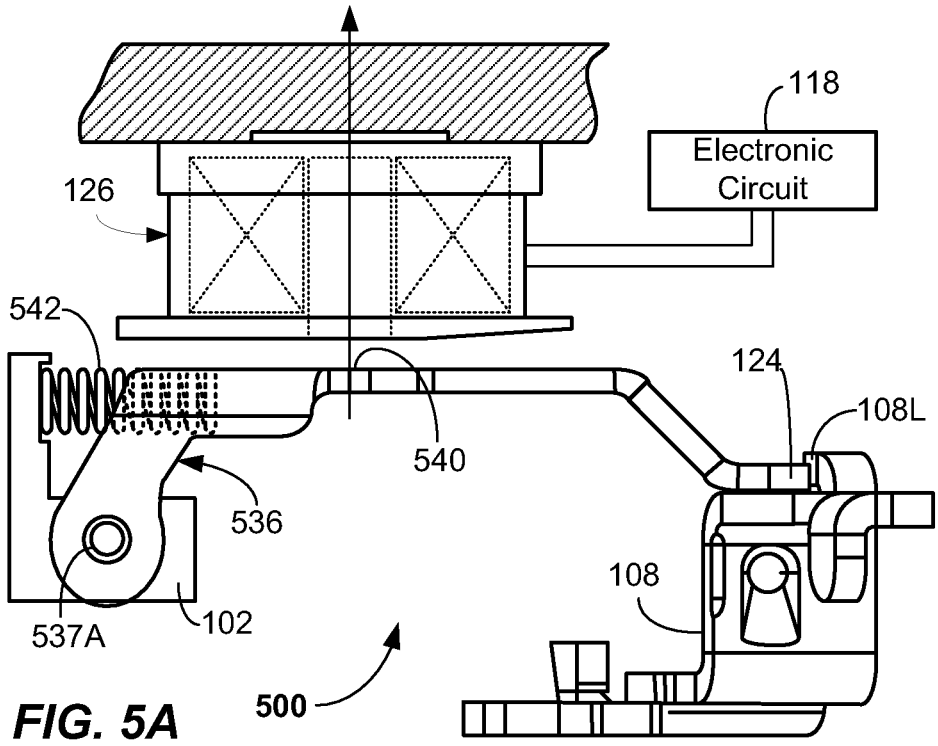
FIG. 5A is a top view of locking and unlocking assembly of a circuit breaker shown in a locking configuration with the main electrical contacts being held open.
Figure 5B:
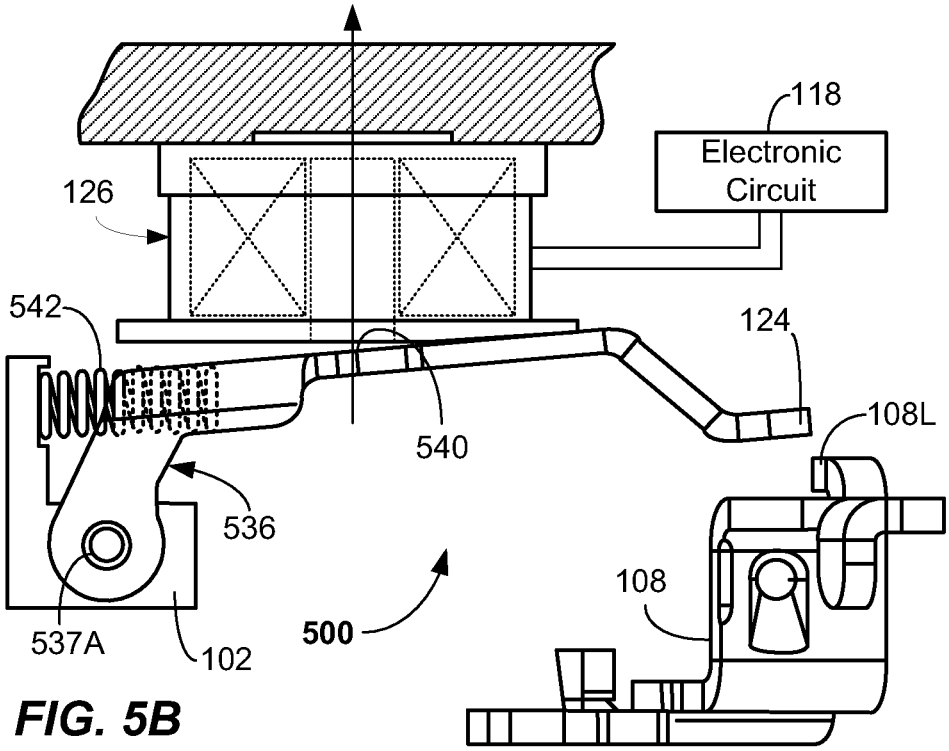
FIG. 5B is a top view of locking and unlocking assembly of a circuit breaker shown in an unlocked configuration allowing the contact arm to close.
Figure 5C:
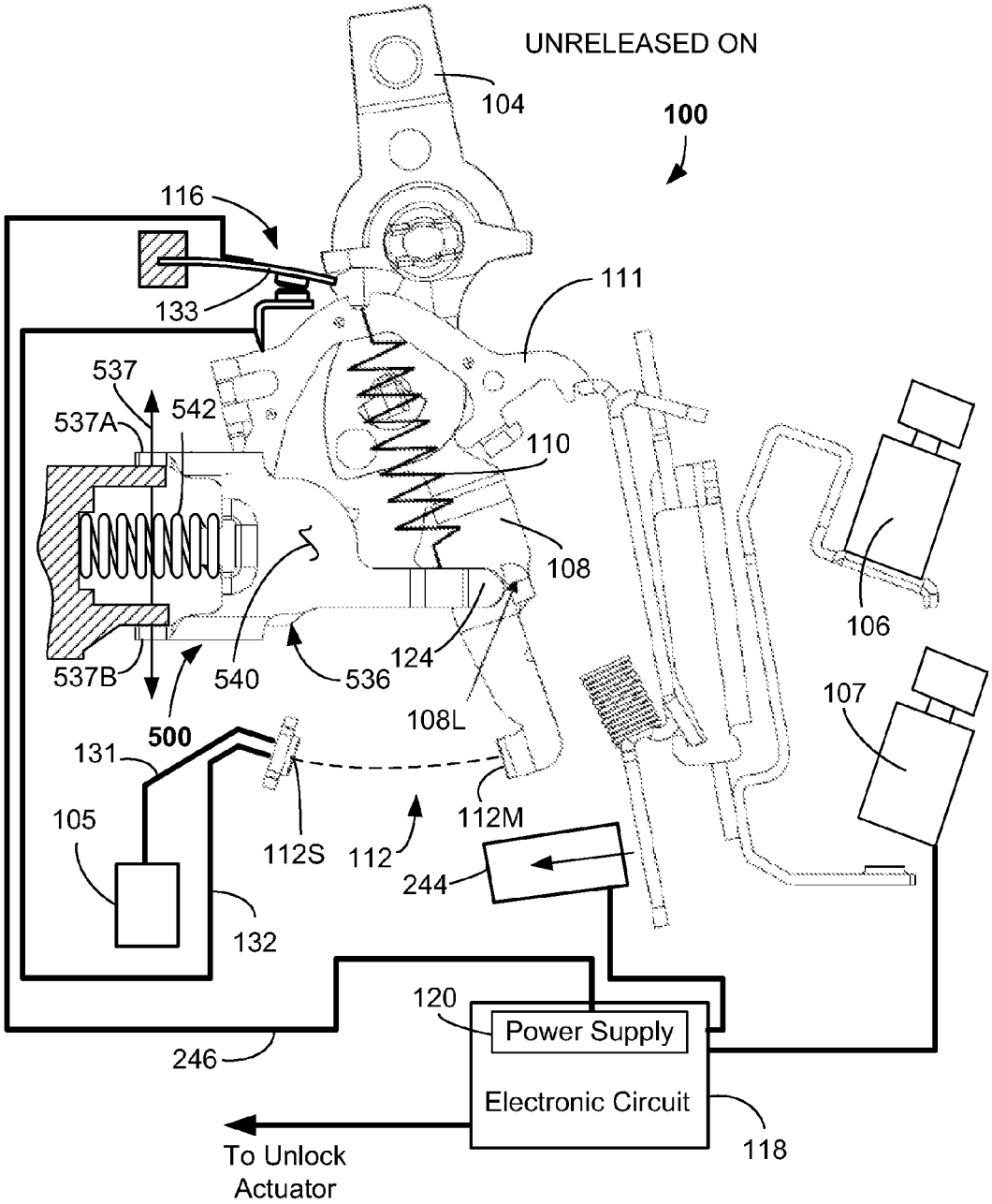
FIG. 5C is a side view of locking and unlocking assembly of a circuit breaker shown in a locked configuration.

Another configuration of a locking and unlocking mechanism 500 is shown in FIGS. 5A-5C. The locking and unlocking mechanism 500 is operable to cause contact with the moveable contact arm 108 and block motion of the moveable main electrical contact. The locking and unlocking mechanism 500 has a lockout latch 536 having one or more pivot joints 537A, 537B operatively pivotal about a pivot axis 537 on a first end, a moveable stop 124 on a second end, and an engagement portion 540 offset from the pivot axis 537, and a bias spring 542, the moveable stop 124 being adapted to contact the moveable contact arm 108 (See FIG. 5A).

The locking and unlocking mechanism 500 also includes an unlock actuator 126 operative to provide an unlock force at the engagement portion 540 causing pivoting of the lockout latch 536 about the pivot axis 537 and release of the moveable contact arm 108 as shown in FIG. 5B to allow the main electrical contacts 112 to close. The moveable contact arm 108 is still shown in an opened configuration in FIG. 5B, as would be the case immediately after unlocking. The action of spring 110 will then close the contact arm 108. The unlock actuator 126 may be any suitable actuator, such as an electromagnet or solenoid. The solenoid shown in FIGS. 5A and 5B includes a core surrounded by coil windings. In the depicted embodiment, the movable contact arm 108 may include an extension member 108L that is adapted to interact with the moveable stop 124 so as to lock (e.g., block) the contact arm 108 from continued motion at certain times during the operation of the circuit breaker 100. The locking member 108L may be formed as a tab extending from a body of the moveable contact arm 108, for example. However, any suitable structure for the locking member 108L that may be contacted by a moveable stop 124 may be used. For example, in an alternative embodiment, the body of the contact arm 108 may be contacted directly. Further disclosure of the locking and unlocking mechanism 500 is provided in U.S. Patent Application entitled "CIRCUIT BREAKER HAVING AN UNLOCKING MECHANISM AND METHODS OF OPERATING SAME," filed contemporaneously herewith by the present assignee, the disclosure of which is hereby incorporated by reference herein in its entirely.

As best shown in FIGS. 5A and 5C, as the handle 104 is moved towards the ON configuration from the OFF configuration, the moveable stop 124 is configured, positioned, and operable to contact and engage the locking member 108L. The moveable stop 124 is normally positioned in a blocking orientation via the spring force exerted by a bias spring 542. The normal motion path of the contact arm 108 as the handle 104 moves towards the ON configuration causes contact between the locking member 108L and the moveable stop 124 and blocks and locks the contact arm 108 in a fixed opened position as shown in FIGS. 5A and 5C. This locking action maintains separation of the main electrical, contacts 112 initially in the unreleased ON configuration shown. The moveable stop 124 is also operable responsive to a signal provided from the electronic circuit 118 to allow closing of the main electrical contacts 112. For example, the main contact closing may be predicated based upon successful completion of a self test of the electronic circuit 118 and/or connected electrical components.

Figure 6:
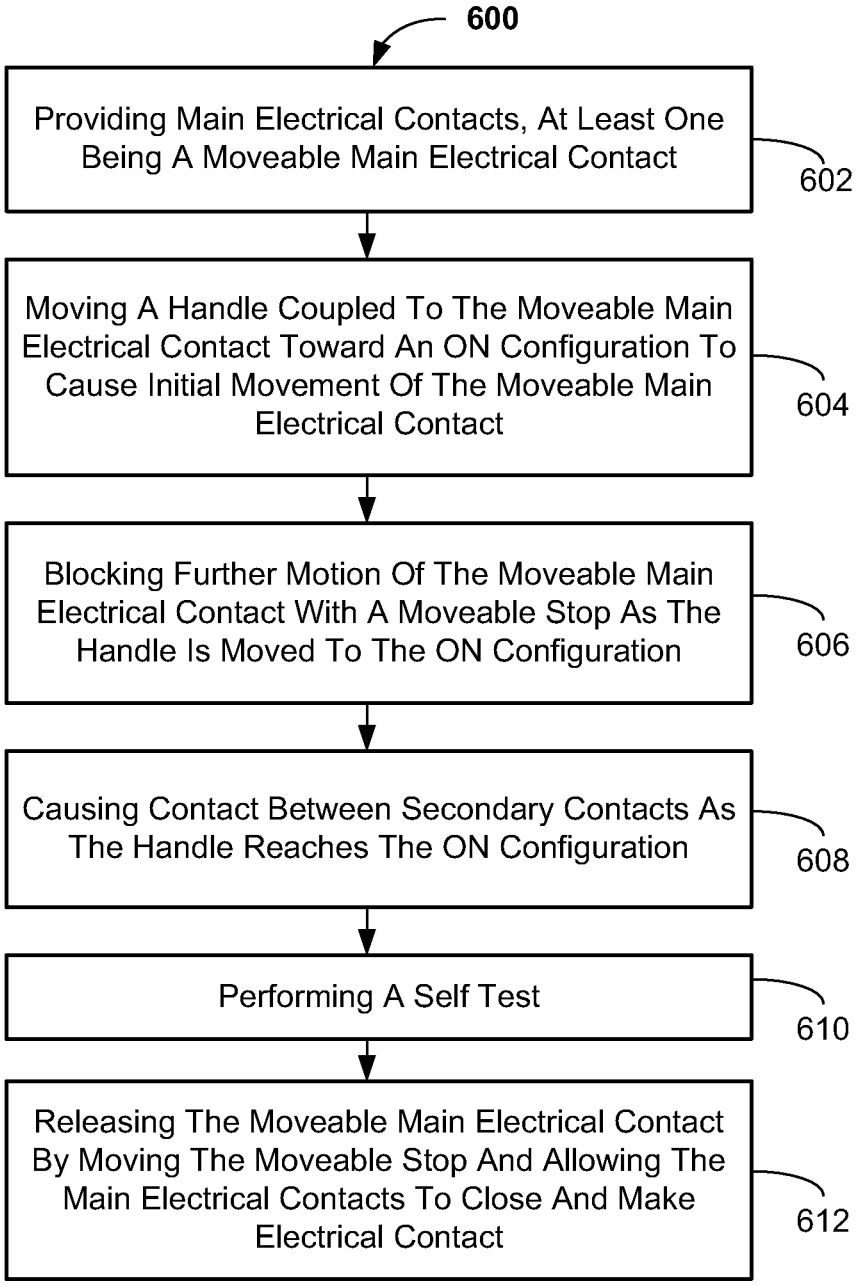
FIG. 6 is a flowchart illustrating a method of operating an electronic circuit breaker according to embodiments of the invention.

FIG. 6 is a flowchart illustrating a method of operating an electronic circuit breaker 100 according to an aspect of the present invention. The method 600 includes providing main electrical contacts (e.g., main electrical contacts 112), at least one being a moveable main electrical contact (e.g., moveable main electrical contact 112M) in 602. In 604, a handle (e.g., handle 104) coupled to the moveable main electrical contact is moved toward an ON configuration causing initial movement of the moveable main electrical contact. In 606, motion of the moveable main electrical contact is blocked with a moveable stop (e.g., moveable stop 124) of the locking and unlocking mechanism as the handle is moved to the ON configuration. This locks the moveable contact arm (e.g., moveable contact arm 108). In 608, contact between secondary electrical contacts (e.g., secondary electrical contacts 116) is caused as the handle reaches the ON configuration (e.g., the unreleased ON configuration). The contact between the secondary electrical contacts may be by the handle contacting the moveable secondary contact (e.g., moveable secondary electrical contact 116M) or by contacting a member attached to the secondary moveable contact (e.g., a leaf spring). The contact between the secondary electrical contacts provides power to the electronic circuit (e.g., electrical circuit 118). Once powered, a self test may be performed in 610. Self test may be automatically initiated when power is provided to the power supply (e.g., power supply 120), or manually initiated by pushing a PTT button (e.g., PTT button 239). In 612, the moveable main electrical contact is released by moving the moveable stop and allowing the main electrical contacts to close and make electrical contact in the released ON configuration. Release may be contingent upon passing pre-established self test criteria. If the self test is failed, then the locking and unlocking mechanism remains locked. The main contacts (e.g., main contacts 112) remain separated, and upon the user releasing the handle, the handle will return to the OFF configuration thereby indicating no power being provided to the protected electrical circuit branch.

It should now be apparent that utilizing the electronic circuit breaker 100 provides the ability to failsafe the circuit breaker 100 as well as to provide power the electronic circuit 118 of the circuit breaker 100 simply when in the ON configuration. Moreover, a simple secondary contact configuration is provided.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the spirit and scope of the invention.

What is claimed is:

1. An electronic circuit breaker, comprising:

main electrical contacts configurable between an opened and closed condition;

a handle coupled to at least one of the main electrical contacts, the handle moveable between at least a released ON configuration, unreleased ON configuration and an OFF configuration;

secondary electrical contacts configured to engage each other in the unreleased ON configuration and in the released ON configuration; and a moveable stop operable to maintain separation of the main electrical contacts initially when moved toward the unreleased ON configuration, and operable to allow closing of the main electrical contacts upon successful completion of a self-test.

2. The electronic circuit breaker of claim 1, comprising a power supply powering an electronic circuit responsive to contact between the secondary electrical contacts.

3. The electronic circuit breaker of claim 1, comprising a first secondary contact and a second secondary contact.

4. The electronic circuit breaker of claim 1, wherein the secondary electrical contacts only contact each other in the unreleased ON configuration and released ON configuration.

5. An electronic circuit breaker, comprising:

main electrical contacts configurable between an opened and closed condition, at least one of the main electrical contacts being a stationary main electrical contact and the other being a moveable main electrical contact, the moveable main electrical contact being mounted on a moveable contact arm;

a handle coupled to the moveable contact arm to enable movement of the moveable contact arm, the handle moveable between at least an OFF configuration, unreleased ON configuration, and a released ON configuration;

secondary electrical contacts configured to engage each other when the handle is in the unreleased ON configuration and released ON configuration; and a moveable stop operable to contact and lock the moveable contact arm and maintain separation of the main electrical contacts when initially moved toward the unreleased ON configuration, the moveable stop adapted to allow release of the moveable contact arm to allow closing of the main electrical contacts upon successful completion of a self test.

6. The electronic circuit breaker of claim 5, wherein closing the secondary electrical contacts provides power to an electronic circuit of the circuit breaker.

7. The electronic circuit breaker of claim 5, wherein the closing of the secondary electrical contacts in the unreleased ON configuration initiates a self test.

8. The electronic circuit breaker of claim 5, wherein the moveable stop is moved by an actuator.

9. A method of operating an electronic circuit breaker, comprising:

providing main electrical contacts, at least one being a moveable main electrical contact;

moving a handle coupled to the moveable main electrical contact toward an unreleased ON configuration causing initial movement of the moveable main electrical contact;

blocking further motion of the moveable main electrical contact with a moveable stop as the handle is moved to the unreleased ON configuration;

causing contact between secondary contacts as the handle reaches the unreleased ON configuration;

performing a self test; and releasing the moveable main electrical contact by moving the moveable stop and allowing the main electrical contacts to close and make electrical contact.

10. The method of operating an electronic circuit breaker of claim 9, comprising:

contacting a moveable contact of the secondary contacts with a handle of the circuit breaker in the unreleased ON configuration.

11. The method of operating an electronic circuit breaker of claim 9, comprising:

providing power to an electrical circuit in the circuit breaker in the unreleased ON configuration.

12. The electronic circuit breaker of claim 5, wherein the secondary electrical contacts only contact each other in the unreleased ON configuration and released ON configuration.

13. The electronic circuit breaker of claim 5, comprising a power supply powering an electronic circuit responsive to contact between the secondary electrical contacts.

14. The electronic circuit breaker of claim 1, wherein the closing of the secondary electrical contacts in the unreleased ON configuration initiates the self test.

15. The electronic circuit breaker of claim 1, wherein the moveable stop is moved by an actuator.

16. The method of operating an electronic circuit breaker of claim 9, comprising:

moving the handle to a released ON configuration if the self-test was successful.

17. The method of operating an electronic circuit breaker of claim 9, comprising:

keeping the secondary electrical contacts closed in the unreleased ON configuration and the released ON configuration.

18. The method of operating an electronic circuit breaker of claim 9, comprising:

moving the moveable stop with an actuator.

19. The method of operating an electronic circuit breaker of claim 9, comprising:

maintaining the separation of the main electrical contacts when the secondary electrical contacts are closed in the unreleased ON configuration.

* * * * *